United States Patent [19]

Muhl, Sr.

[11] 4,326,120

[45] Apr. 20, 1982

[54] TEMPERATURE CONTROL SYSTEM FOR AN ELECTRODE TYPE LIQUID HEATER

[76] Inventor: Andrew H. Muhl, Sr., 2109 Huldy, Houston, Tex. 77019

[21] Appl. No.: 149,237

[22] Filed: May 12, 1980

[51] Int. Cl.[3] ..... H05B 3/60; F22B 1/30

[52] U.S. Cl. ..... 219/286; 219/289; 219/293; 219/295; 338/81; 338/83

[58] Field of Search ..... 219/284–295, 219/317; 338/80–86

[56] References Cited

U.S. PATENT DOCUMENTS

| | | | |
|---|---|---|---|
| 1,293,964 | 2/1919 | Spink | 219/286 |
| 1,405,475 | 2/1922 | Andrews | 219/285 |
| 1,648,588 | 11/1927 | Nerew | 219/285 |
| 2,090,282 | 8/1937 | Bock | 219/286 |
| 2,336,011 | 12/1943 | Haberstump | 219/317 X |
| 3,053,964 | 9/1962 | Foley et al. | 219/285 |
| 3,809,857 | 5/1974 | Muhl | 219/286 |

FOREIGN PATENT DOCUMENTS

| | | | |
|---|---|---|---|
| 179210 | 3/1936 | Switzerland | 219/284 |
| 1385066 | 2/1975 | United Kingdom | 219/285 |

*Primary Examiner*—A. Bartis

*Attorney, Agent, or Firm*—W. F. Hyer; Herbert E. O'Niell

[57] ABSTRACT

An apparatus for heating an electrically conductive liquid, such as water, includes a rotatable, balanced, buoyant heating assembly floating in a quantity of conductive liquid partially filling a tank. A pair of opposite polarity electrodes are mounted on the buoyant assembly and a neutral electrode is mounted in the liquid in the tank for heating the liquid by current flow between the electrodes. The buoyant heating assembly is hingedly mounted in the tank and is rotatable by means of a bimetallic coil responsive to the temperature of the liquid from a first position, wherein the pair of electrodes is immersed in the liquid to heat the liquid, to a second position, wherein the electrodes are out of the liquid to terminate the heating process. In one embodiment the spacing between the electrodes on the buoyant heating assembly may be selectively adjusted from outside of the tank to vary the heating rate.

12 Claims, 5 Drawing Figures

TEMPERATURE CONTROL SYSTEM FOR AN ELECTRODE TYPE LIQUID HEATER

BACKGROUND OF THE INVENTION

1. Field of the Invention

This invention relates to heaters for electrically conductive liquids in which the liquid is heated by an electrical current between spaced electrodes located in the liquid.

2. Description of the Prior Art

Heating a conductive liquid, such as water, by passing an electrical current through it is known in the art. Heating of the liquid in response to the current is rapid and therefore electrode type heaters are particularly suited for mobile homes, portable homes, and recreational vehicles where a large quantity of water need not be heated and stored. An electrode type water heater may be of a small size, which is advantageous where space is limited.

In the conventional electrode type heater the electrodes are submerged at all times in the liquid. With this arrangement problems arise in controlling the current between the electrodes to regulate the heat of the liquid. One problem in the prior art is current surge, with commensurate line voltage drop, which occurs when a voltage is suddenly applied to electrodes located in a conductive liquid. A substantial part of the prior art is thus concerned with regulating the current in the liquid. In U.S. Pat. No. 1,293,964, current is regulated by mounting the electrodes on oppositely rotating bi-metallic springs to vary the distance between the electrodes. In U.S. Pat. No. 1,706,146, current is regulated by varying the length of the path the current must travel in the liquid by maintaining spacing between electrodes of opposite polarity while rotating the electrodes of one polarity away from the electrodes of the opposite polarity. U.S. Pat. No. 2,428,445, operates upon a similar principle. In U.S. Pat. No. 2,812,416, current is regulated by varying the depth of the electrodes in a liquid. U.S. Pat. No. 3,356,827, regulation of current in a liquid is accomplished by interposing a nonconductive shield between opposite electrodes. In U.S. Pat. No. 3,666,916, current is regulated by adjusting the distance between opposite electrodes in combination with a movable shield between the electrodes. In U.S. Pat. No. 3,053,964, of which the present applicant was co-inventor, current is regulated by adjusting an insulated shield between electrodes of opposite polarities. In U.S. Pat. No. 3,144,546, of which the present applicant was also a co-inventor, regulation is accomplished by moving an electrode or both electrodes from a position in the liquid to a position in a body of nonconductive gas disposed above the liquid. In U.S. Pat. No. 3,809,857, of which the present applicant is inventor, current is controlled by moving the electrodes into or out of the liquid to be heated in response to a change in temperature of the liquid. This is accomplished by mounting the electrodes on a counterbalanced buoyant cylinder and mounting a thermostatically controlled movable counterweight on the buoyant cylinder generally opposite the electrodes. In response to a change in temperature of the liquid in the tank, the movable counterweight moves away from the shaft which thereby shifts the center of gravity and rotates the shaft, rotating the electrodes into or out of the liquid. Slotted support guides receive shafts mounted with the buoyant cylinder to allow the cylinder to rotate and to float on the liquid as its level changes. While the apparatus of this patent is believed to be simple and effective, it is believed that the present invention will effect the same result in a different and improved manner.

SUMMARY OF THE INVENTION

Accordingly, it is an object of this invention to provide an electrode type liquid heater which is simple and economical to manufacture, and thus competitive in price with conventional liquid heaters.

It is another object of this invention to provide an electrode type liquid heater with improved and simplified thermostatic temperature control means to reduce the possibility of breakdown and to simplify repairs.

Another object is to provide such a heater in which the current through the liquid may be varied from the exterior of the tank in response to changes in the quality of the water, such as salinity.

These and other objects, advantages and features, as disclosed by the specification herein, are accomplished by providing an electrode type liquid heater which includes a tank for containing the liquid to be heated, such as water. The tank has an inlet to supply liquid to be heated and an outlet to draw off the heated liquid. In normal operation, the tank is not completely filled with liquid, but a volume of nonconductive gas is maintained over the liquid in the tank.

In the preferred embodiment, a buoyant heating assembly comprising a buoyant cylinder is mounted for rotation in the tank. Two electrodes are mounted with the cylinder and a third neutral or ground electrode is mounted on the tank. A counterweight is provided to balance the cylinder and electrodes so that relatively little force is required to rotate the assembly. The buoyant cylinder is rotatably mounted with hinged supports which are pivotal with respect to the tank, allowing the cylinder to float on the liquid in the tank if the liquid level in the tank changes. A thermostat, preferably a coiled bimetallic member, is provided with one end fixed to the hinged support and with the other end engaging the buoyant cylinder to rotate the assembly in the liquid as the temperature of the liquid in the tank changes.

In the normal operation of the heater of the invention, when the liquid in the tank is to be heated, the buoyant cylinder is rotatably disposed such that the electrodes are located in the liquid and the thermostat coil is relatively relaxed in response to the temperature of the liquid. A 220 volt potential is applied between the electrodes on the cylinder and a ground connection is made to the neutral electrode, so that the potential between the ground and the cylinder electrodes is 110 volts. An electrical current through the liquid heats the liquid. As the temperature of the liquid increases, the thermostat coil becomes tense and coils, exerting a rotational force on the heating assembly, causing the electrodes to rotate toward the liquid-nonconductive gas interface in the tank. At a predetermined temperature, determined by the chosen characteristics of the thermostat coil, one of the electrodes is rotated completely out of the conductive liquid, stopping the current between the cylinder electrodes. However, current continues to flow between the immersed cylinder electrode and the neutral electrode at the lesser potential of 110 volts, until both cylinder electrodes are out of the liquid and heating ceases. As the temperature of the liquid decreases, the thermostatic coil relaxes, rotating the buoyant cylinder until the electrodes are in the conductive liquid and heating is resumed. In this manner, the temperature of the liquid can be maintained at a chosen setting without the use of a shifting mass, rheostats, mechanical linkages, or complicated control means.

In a second embodiment of the invention, means are provided for varying the spacing between the cylinder electrodes from the outside of the tank. The electrical conductivity of liquids, for example water, varies according to its purity, e.g. salinity, and temperature. By varying the spacing between the electrodes, and thus the distance the current must travel through the liquid, the rate of heating of the liquid can be varied. Adjustments can also be accomplished by internal means if desired.

DESCRIPTION OF THE PREFERRED EMBODIMENT

Reference to the heating of water, will be made in the following detailed description, however, it must be noted that the invention is equally suitable for heating any conductive liquid.

Figure 1:
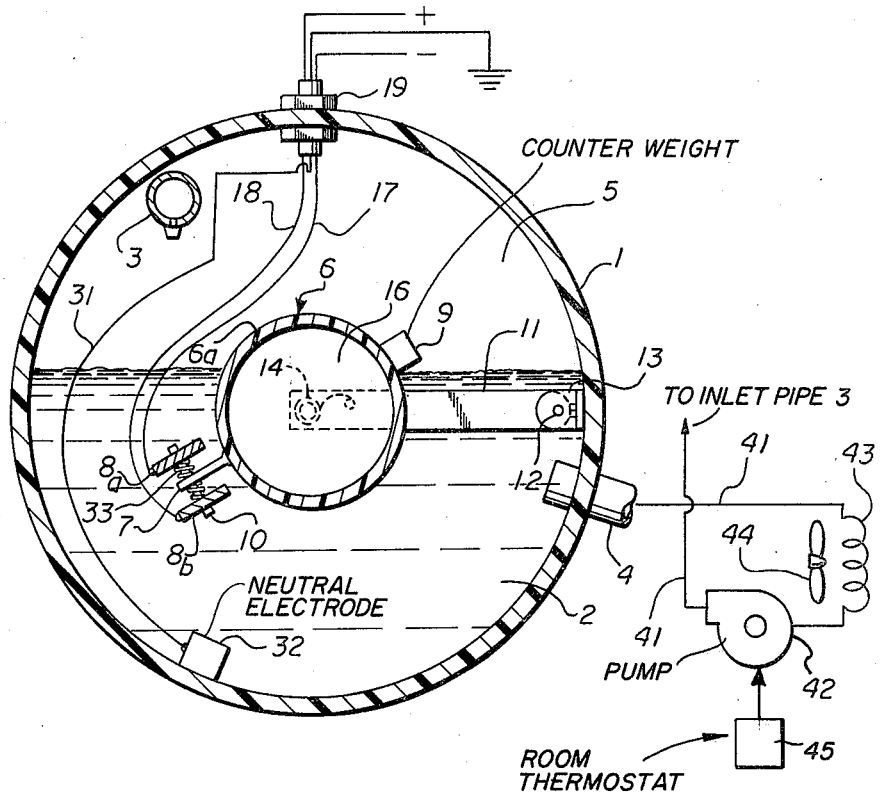
FIG. 1 is a vertical cross sectional view of the liquid heater of the invention in the heating mode.
Figure 3:
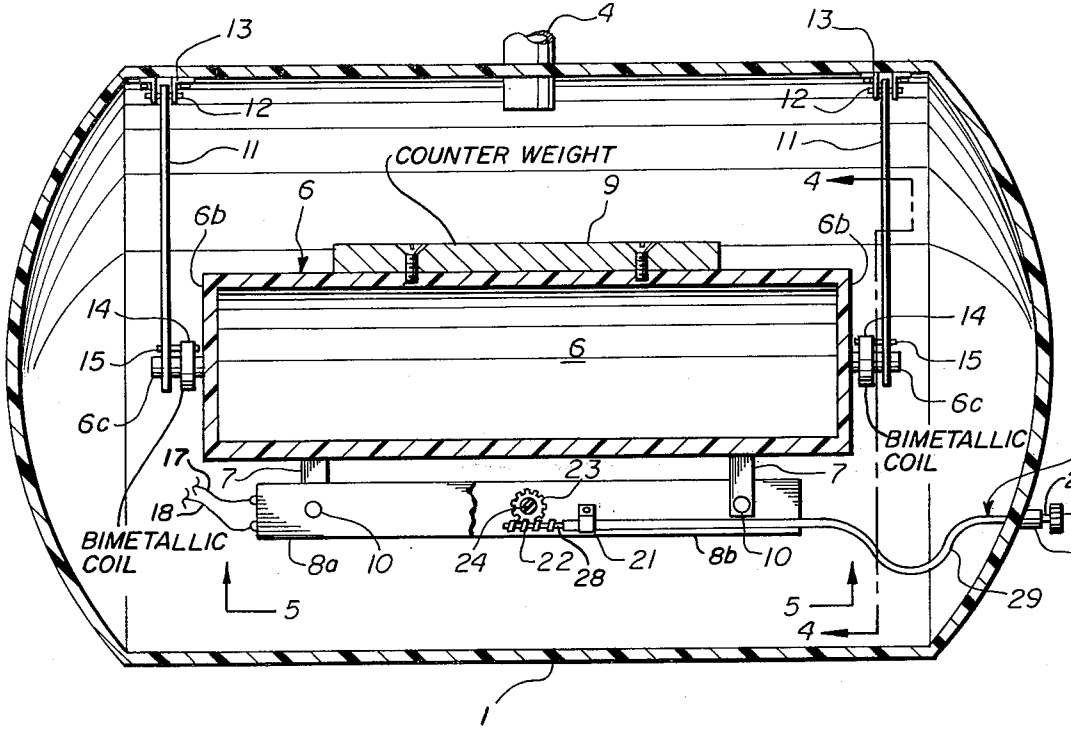
FIG. 3 is a horizontal partial sectional and plan view of the invention.

Now, with particular reference to FIGS. 1 and 3, a tank 1 is shown partially filled with water 2. The tank is preferably of an electrically nonconductive material, such as fiberglass or plastic to reduce shock hazards and thereby minimizing weight, shipping costs, and easing installation of the heater. An inlet pipe 3 for supplying water to be heated enters the tank through an end thereof. An outlet pipe 4 for drawing off heated water is located approximately 3" from the top of the water area in tank. The rate of supply of water to be heated and the rate of removal of heated water are regulated by any suitable means so that the tank is always partially filled with water. A volume of nonconductive gas 5 fills the remainder of the volume of the tank above the water. A buoyant heating assembly 6 comprises a sealed cylinder 6*a*, a pair of electrodes 8*a*, 8*b*, a bracket 7 for mounting the electrodes with the cylinder 6*a*, and a counterweight 9. The cylinder 6*a* is sealed at each end by end plates 6*b*, which are attached such that the cylinder is air and water tight. The cylinder is designed in weight and displacement so that the heating assembly is buoyant and floats in the water in the tank. A pair of electrically nonconductive brackets 7 are attached spaced longitudinally, to the outside surface of the cylinder 6*a*. Guides 10, preferably electrically nonconductive cylindrical rods, extend through holes in the brackets 7 and are fixed to the brackets. The longitudinal axes of the guides are preferably coplanar to facilitate mounting the electrodes 8*a*, 8*b* with the guides 10.

Figure 5:
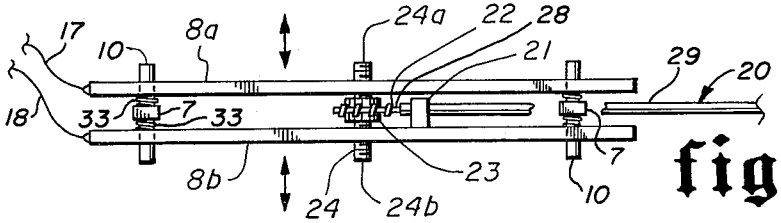
FIG. 5 is a vertical view along line 5—5 of FIG. 3.

The electrodes 8*a*, 8*b* are longitudinally extended flat plates of electrically conductive material. A pair of spaced apart holes is formed through each electrode 8*a* or 8*b* so that each may be slidably mounted on the guides 10 on either side of the bracket 7, as best shown in FIGS. 1 and 5. The electrodes 8 may be fixed to the guides 10 with screws (not shown) or any other suitable means so that the electrodes are generally parallel.

Three electrically conductive wires 17, 18, and 31 extend from a typical 220 volt/110 volt three wire electrical source (not shown) through an air and water tight fitting 19 through the tank 1. Wire 31, the neutral wire of the three wire source, is connected to a ground electrode 32 mounted on the tank 1 and submerged in the liquid. The ground electrode is preferably approximately 80% of the size of the movable electrodes. Wires 17 and 18, having a potential between them of 220 volts, are connected each to an electrode 8*a*, 8*b*. A 220 volt source is preferable in that heating of the liquid is rapid. The neutral electrode 32 reduces shock hazard by providing an electrical system ground in the tank. Although a three electrode embodiment is described, it should be understood that the invention is equally applicable to other power sources, such as a three phase, four wire source.

A counterweight 9 is affixed to tube 6*a* generally opposite from brackets 7. The mass of the counterweight 9 is such that it counterweighs the effective mass of the brackets 7, the guides 10, and the electrodes 8*a*, 8*b* and their respective means of attachment, thus rotationally balancing the heating assembly 6.

Bearing shafts 6*c* are fixed to the end plates 6*b* on the tube 6*a* by any suitable means and supports 11 are provided with a hole formed through an end thereof for receiving the bearing shafts 6*c*. The supports position the shaft assembly in the tank and are preferably relatively rigid, longitudinally extended flat plates. A hole is formed in the opposite end of each of the supports 11 for receiving the pins 12 of the hinges 13 which are mounted with the inside surface of the tank 1. As best seen in FIG. 1, the hinges 13 are preferably mounted with the tank at a point below the water level in the tank so that the supports 11 are submerged, for reasons explained below. The hinges 13 permit the rotation of the supports 11 and thus the heating assembly 6 about the axis of pins 12. If the water level in the tank changes, the heating assembly 6 rises and falls with the water level and thereby maintains its floating position in the water in the tank.

Figure 4:
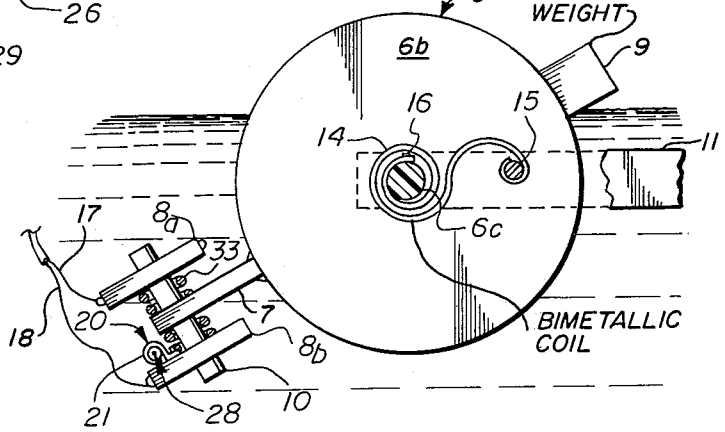
FIG. 4 is a vertical view along line 4—4 of FIG. 3.

The thermostat 14 is preferably a bimetallic coil for exerting a rotational torque to rotate the buoyant heating assembly in response to changes in temperature of the water in the tank. Preferably, the displacement of the cylinder is chosen so that the heating assembly floats at the level in the water shown in FIG. 4, maintaining the thermostat 14 in contact with the water in the tank at all times. When the supports 11 are mounted within the tank below the liquid level, the thermostat is completely immersed in the liquid, enhancing the response of the thermostat to changes in temperature of the liquid of the tank. As best shown in FIG. 4, a first end of bimetallic coil comprising thermostat 14 is attached to the bearing shaft 6*c* by a bolt 16. The second end of the bimetallic coil of thermostat 14 is formed for slidably engaging over a pin 15 mounted with the support 11 to fix the outer part of the thermostat 14 relative to the buoyant cylinder.

The bi-metallic coal comprising thermostat 14 is temperature sensitive. As its temperature changes the coil ends move in arcuate paths so that if one end is fixed, the coil will wind or unwind in response to the differing rates of the thermal expansion of the dissimilar metals of the coil to exert a rotational torque on the shaft 6*c*. As best seen in FIG. 4, a rise in the temperature of the water in the tank causes the thermostat 14 to tend to wind in a clockwise manner. A rotational torque is transmitted to the bearing shaft 6c, causing the clockwise rotation of the counterbalanced heating assembly 6 to remove the electrodes 8 from water. Similarly, as the temperature of the liquid in the tank decreases, the thermostat 14 will tend to relax or unwind in the counter clockwise direction causing the bearing shaft 6c and the counterbalanced heating assembly 6 to rotate in a counter clockwise direction to immerse the electrodes. The heating assembly 6 floats at a depth in the liquid such that the thermostat 14 is immersed in the liquid so that it can respond immediately to changes in the temperature of liquid. In the preferred embodiment, two thermostats, each mounted on a bearing shaft 6c as recited above, cooperate to rotate the buoyant counterweighted heating assembly from a first position where the electrodes are both in contact with the liquid to a second position where the electrodes are rotated out of the liquid.

Figure 2:
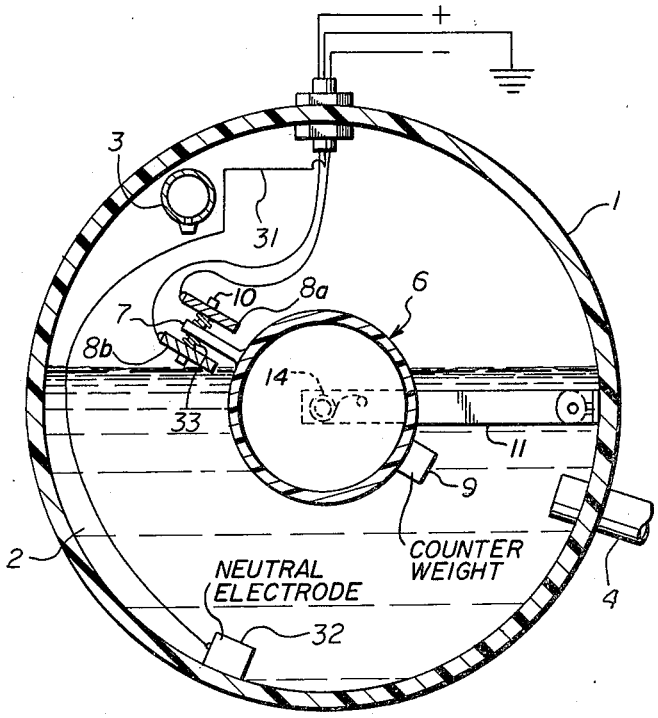
FIG. 2 is a vertical cross sectional view of the invention in the non-heating mode.

In the normal operation of the liquid heater in the heating mode, the electrodes 8a, 8b are rotationally disposed in the liquid. A 220 volt differential exits between the electrodes 8a and 8b, causing a current through the liquid. As the temperature of the liquid increases, the thermostats 14, which are in contact with the liquid, coil and exert a rotational torque on the bearing shafts 6c and thereby the heating assembly 6. The heating assembly is rotated from the first, heating position of FIG. 1 toward the second nonheating position of FIG. 2. Because the heating assembly 6 is balanced by counterweight 9, the thermostats 14 need exert only a relatively small rotational torque to rotate the assembly.

The thermostats gradually rotate the electrode 8a out of the liquid so that the electrical connection between first electrode 8a and the second electrode 8b is gradually diminished. When the first electrode 8a is free of the water, current will continue to flow, at the lesser potential of 110 volts, between the ground 32 and the second electrode 8b, until the second electrode is gradually rotated from the water body and the heating current ceases. Similarly, when the liquid in the tank cools, due to the drawing off of heated liquid and its replacement with unheated liquid, the thermostats 14 gradually rotate the electrodes from the nonconductive gas into the liquid to re-establish heating of the liquid without current surges. The gradual movement of the electrodes and the change in the potential between the heating electrodes resulting from the removal (or reimmersion) of electrode 8a from the water prevents current surge.

It should be noted that the operation of the liquid heater as described above is fully automatic and through the proper selection of suitable thermostats 14 the temperature of the liquid may be maintained at any given value.

In a second embodiment, the invention as described above is provided with a means for varying the spacing between the electrodes and thereby the resistance to current through the liquid from the exterior of the tank.

Adjustment of the electrode spacing is useful to compensate for differences in water quality at different locations. The salinity or mineral content of water commonly varies from place to place. The natural effect of such variation is a difference in the conductivity of the water. By adjustment of the spacing of the electrodes, the operation of the heater may be standardized for the liquid to be heated.

In this embodiment, best illustrated by FIG. 3, the electrodes have holes formed therethrough of slightly larger diameter than and designed for slidably mounting over guides 10. Springs 33 slidably mounted over the guides 10 urge the electrodes 8a, 8b apart and, with the screw 24 prevent free movement of the electrodes on the guides 10. At the approximate longitudinal midpoint of each electrode 8 is a threaded hole extending through the electrode. The direction of the threading is opposite in each electrode, that is, a right hand thread in one electrode 8a and a left hand thread in the opposite electrode 8b. A nonconductive threaded screw 24 is provided with two differently threaded ends 24a and 24b to engage the corresponding threads in the electrodes. Turning the screw 24 causes the electrodes to move either toward or away from each other.

A pinion gear 23, which is preferably also nonconductive to prevent shock hazards, is fixed on the screw 24. A flexible cable 20 extends through the tank wall through a water tight fitting 26. An adjustment knob 27 permits rotation of the central wire 28 of the flexible cable 20. The flexible sheath 29 of the cable 20 terminates with a worm gear 22 connected to the central wire 28 and engaged with the pinion gear 23 by the clip 21. By turning the adjustment knob 27, the worm gear 22 is rotated, respectively advancing or retreating the electrodes 8a and 8b, thus increasing or decreasing the spacing between the electrodes.

The heater of the invention is typically in a stand-by state for approximately 90% of a 24 hour period. For approximately 10% of the period it is under demand, supplying heated water. The invention is useful as stand-by means for heating a home or building by supplying heated water to a radiator or other heat transfer device. In FIG. 1, a closed circuit system is schematically represented. Heated water is removed from the tank outlet 4 through a suitable conduit 41 by a thermostatically controlled system pump 42. The hot water enters a radiator 43. If desired, heat transfer may be enhanced by a suitably powered fan 44. The system pump 42 recirculates the cooled water to the tank inlet 3. When, for example, room temperature drops below a selected point, the room temperature responsive thermostat 45 actuates the pump 42 to circulate the water in the system. A system having heat transfer coils embedded in a road surface, for example, may be used in automatically de-ice a bridge or highway overpass.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

The invention having been described, what is claimed is:

1. An apparatus for heating an electrically conductive liquid comprising:

a tank for containing the conductive liquid; means for supplying the tank with liquid to be heated; means for removing heated liquid from the tank; means for maintaining a body of an electrically nonconductive gas over the liquid in the tank; at least two spaced apart electrodes of opposite polarity in the liquid in the tank when said tank contains liquid; means for applying a first voltage differential to the electrodes; a buoyant heating assembly having sufficient buoyancy to float in the liquid in the tank; means for mounting at least one of the electrodes with the buoyant heating assembly; means for movably mounting the buoyant heating assembly inside of the tank whereby the heating assembly rises or falls with the level of the liquid in the tank; means mounted on the means for mounting the buoyant heating assembly inside the tank and the buoyant heating assembly for allowing rotation of the heating assembly about a rotational axis on the heating assembly from a first position wherein the at least one electrode is at least partially immersed in the conductive liquid to heat the liquid to a second position wherein the at least one electrode is disposed in the body of nonconductive gas; and a thermostat for applying a rotational force to the heating assembly in response to a change in the temperature of the liquid in the tank comprising a thermostatic coil in the liquid in the tank and having first and second ends which move in arcuate paths responsive to temperature changes, the first end being connected to the buoyant heating assembly and the second end being fixed relative to the buoyant heating assembly so that a change in temperature of the liquid in the tank causes the coil to rotate the buoyant heating assembly about its rotational axis from the first position to the second position in response to an increase in temperature of the liquid and from the second to the first position in response to a decrease in temperature of the liquid.

2. The apparatus as set forth in claim 1, including a neutral electrode immersed in the conductive liquid in the tank and including means for applying a second voltage differential between the neutral electrode and said at least two spaced apart electrodes, said second voltage differential comprising a lesser potential than said first voltage differential.

3. The apparatus of claim 1 or 2, wherein the thermostat comprises a bimetallic coil.

4. The apparatus of claim 1 or 2, wherein the buoyant heating assembly includes means mounted with the heating assembly for balancing the heating assembly, whereby only a relatively small force from said thermostatic coil is required to rotate the heating assembly about its rotational axis.

5. The apparatus of claim 4, wherein the means for balancing the heating assembly comprises a counterweight mounted with the heating assembly.

6. The apparatus of claim 1 or 2, wherein the second end of the thermostatic coil is mounted with the means for movably mounting the buoyant heating assembly inside the tank.

7. The apparatus of claim 6, wherein the means for movably mounting the buoyant heating assembly inside the tank comprises at least one elongate support having a first end pivotally mounted with the interior of the tank and a second end rotationally mounting the buoyant heating assembly.

8. The apparatus of claim 7, including a counterweight mounted with heating assembly for balancing the heating assembly.

9. The apparatus of claim 8, including a plurality of thermostatic coils and a plurality of elongate supports wherein the second end of each of said thermostatic coils is mounted with an elongate support and the first end of each of said thermostatic coils is mounted with the buoyant heating assembly.

10. The apparatus of claim 1 or 2, wherein a plurality of said electrodes of opposite polarity are mounted on said bouyant heating assembly and means is provided for varying the spacing between the electrodes of opposite polarity mounted on said buoyant heating assembly from a point exterior of the tank, whereby the current flow between the electrodes may be adjusted from the exterior of the tank.

11. The apparatus of claim 10, wherein the means mounting the plurality of said electrodes with the heating assembly comprises at least one guide mounted on the heating assembly, and including means for mounting the said plurality of electrodes with the guide wherein at least one of the plurality of said electrodes is slidably mounted with the guide whereby the spacing between the electrodes is variable by sliding the at least one electrode on the guide, and wherein the means for varying the spacing between the plurality of said electrodes comprises a flexible cable, means for mounting a first end of the cable through the tank in a leak tight manner, a worm gear fixed to a second end of the cable, a threaded hole formed in said at least one of the electrodes, a screw threadingly engaging with the threaded hole formed in said at least one electrode, a pinion gear mounted with the screw and engaging with the worm gear whereby turning the worm gear rotates the screw, means for mounting the screw for rotation whereby turning the end of the cable exterior of the tank turns the worm gear and the screw thereby threadably advancing or returning said at least one electrode slidably on the guide, thereby varying the spacing between the electrodes.

12. The apparatus of claim 11, wherein the plurality of said electrodes mounted with the heating assembly comprises two electrodes; the electrodes having oppositely threaded holes formed therein; the ends of the screw being oppositely threaded, said threaded ends being engaged with the opposite threads in the threaded holes of the electrodes; and both electrodes are slidably mounted with the guide, whereby turning the cable from outside the tank rotates the screw thereby moving one electrode either toward or away from the other and varying the spacing between the electrodes.

* * * * *